US009570029B2

(12) United States Patent
Kim et al.

(10) Patent No.: US 9,570,029 B2
(45) Date of Patent: Feb. 14, 2017

(54) DISPLAY DEVICE

(71) Applicant: LG Display Co., Ltd., Seoul (KR)

(72) Inventors: Hyunchul Kim, Gyeongbuk (KR); Daehwan Kim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/981,519

(22) Filed: Dec. 28, 2015

(65) Prior Publication Data

US 2016/0189653 A1 Jun. 30, 2016

(30) Foreign Application Priority Data

Dec. 31, 2014 (KR) ..... 10-2014-0195750

(51) Int. Cl.

*G09G 3/36* (2006.01)
*G09G 3/20* (2006.01)
*G09G 3/32* (2016.01)

(52) U.S. Cl.

CPC ..... *G09G 3/3677* (2013.01); *G09G 3/20* (2013.01); *G09G 3/3266* (2013.01); *G09G 2300/0408* (2013.01); *G09G 2300/0426* (2013.01); *G09G 2310/0218* (2013.01); *G09G 2310/0267* (2013.01); *G09G 2310/08* (2013.01); *G09G 2320/0223* (2013.01)

(58) Field of Classification Search

CPC ..... G09G 3/30
USPC ..... 327/108
See application file for complete search history.

(56) References Cited

U.S. PATENT DOCUMENTS

2004/0263452 A1 12/2004 Kim
2008/0094321 A1* 4/2008 Park ..... G09G 3/3225 345/76
2009/0289884 A1 11/2009 Yanagi et al.
2012/0038610 A1* 2/2012 Li ..... G09G 3/3696 345/211
2012/0262467 A1 10/2012 Yu
2013/0088470 A1 4/2013 Chang et al.
2013/0107152 A1* 5/2013 Okumura ..... G09G 3/3677 349/41
2014/0111718 A1 4/2014 Chen et al.

OTHER PUBLICATIONS

European Extended Search Report, European Application No. 15190518.9, May 12, 2016, 10 pages.

* cited by examiner

*Primary Examiner* — William Boddie
*Assistant Examiner* — Jeffrey A Parker
(74) *Attorney, Agent, or Firm* — Fenwick & West LLP

(57) ABSTRACT

A gate driver drives a display panel. First and second gate pulse generator circuits each drives a high supply voltage onto respective gate lines via respective high drive transistors during a gate pulse period and discharge their respective gate lines through the respective high drive transistors during a discharge period. A gate pulse modulation circuit provides the high supply voltage to the first gate pulse generator and the second gate pulse generator via an output terminal during the first pulse period and the second pulse period and couples a source terminal of the first high drive transistor and a source terminal of the second high drive transistor to a first return line via the output terminal during the first and second discharge periods.

17 Claims, 6 Drawing Sheets

DISPLAY DEVICE

This application claims the benefit of Korean Patent Application No. 10-2014-0195750 filed on Dec. 31, 2014, which is incorporated herein by reference for all purposes as if fully asset forth herein.

BACKGROUND OF THE INVENTION

Field of the Invention

This document relates to a display device.

Discussion of the Related Art

Flat panel displays include liquid crystal displays (LCDs), field emission displays (FEDs), plasma display panels (PDPs), organic light emitting diode displays (OLEDs), and so on. In a flat panel display, data lines and gate lines are disposed to cross at right angles, and a crossing of a data line and a gate line is defined as a pixel. A plurality of pixels are formed in a matrix on a panel. To drive each pixel, a video data voltage to be displayed is supplied to the data lines, and a gate pulse is sequentially supplied to the gate lines. And, the video data voltage is supplied to the pixels on display lines to which the gate pulse is supplied. As every display line is sequentially scanned by the gate pulse, video data is displayed.

In keeping with the recent trend of large-sized panels for displays, the gate lines are becoming longer, and this leads to problems due to gate pulse delays. As one of the measures to solve these problems, gate pulse modulation (GPM) was suggested, in which the voltage level of a gate pulse is raised and the voltage level decreases with a different slope during the fall time.

A GPM IC that generates a GPM signal by gate pulse modulation may be incorporated in each gate drive IC. A problem with this technique is that GPM signals generated by the GPM IC of each gate drive IC have different waveforms due to differences in resistance between RE lines needed for gate pulse modulation.

SUMMARY OF THE INVENTION

In a first embodiment, a gate driver drives a display panel. A first gate pulse generator circuit receives gate timing control signals and generates a first gate pulse on a first gate line by driving a high supply voltage onto the first gate line via a first high drive transistor during a first gate pulse period. The first gate pulse generator circuit furthermore discharges the first gate line through the first high drive transistor during a first discharge period following the first gate pulse period. The first gate pulse generator circuit furthermore drives a low supply voltage onto the first gate line via a first low drive transistor during a first gate off period following the first discharge period.

A second gate pulse generator circuit receives the gate timing control signals and generates a second gate pulse on a second gate line by driving the high supply voltage onto the second gate line via a second high drive transistor during a second gate pulse period. The second gate pulse generator circuit furthermore discharges the second gate line through the second high drive transistor during a second discharge period following the second gate pulse period. The second gate pulse generator circuit furthermore drives the low supply voltage onto the second gate line via a second low drive transistor during a second gate off period following the second discharge period.

A first gate pulse modulation circuit provides the high supply voltage to the first gate pulse generator and the second gate pulse generator via an output terminal during the first pulse period and the second pulse period. The first gate pulse modulation circuit furthermore couples a source terminal of the first high drive transistor and a source terminal of the second high drive transistor to a first return line via the output terminal during the first and second discharge periods.

In a second embodiment a gate driver integrated circuit comprises a gate pulse generator circuit, a gate pulse modulation circuit, a first conductive pad, and a first conductive pattern.

The gate pulse generator circuit receives gate timing control signals and generates a gate pulse on a gate line by driving a high supply voltage onto the gate line via a high drive transistor during a gate pulse period. The gate pulse generator circuit furthermore discharges the gate line through the high drive transistor during a first discharge period following the gate pulse period. The gate pulse generator circuit furthermore drives a low supply voltage onto the gate line via a first low drive transistor during a gate off period following the discharge period.

The gate pulse modulation circuit has an enable terminal to enable or disable the gate pulse modulation circuit. When enabled, the gate pulse modulation circuit provides the high supply voltage to the gate pulse generator via an output terminal during the pulse period and couples a source terminal of the high drive transistor to a return line via the output terminal during the discharge period.

The first conductive pad is coupled to receive the high supply voltage from an external source during the pulse period and provides a discharge path to an external return line during the discharge period when the gate pulse modulation circuit is disabled.

The first conductive pattern couples the first conductive pad to the source terminal of the high drive transistor when the gate pulse modulation circuit is disabled.

In another embodiment, a method generates a gate driver signal. A first gate pulse generator circuit receives gate timing control signals. The first gate pulse generator circuit generates a first gate pulse on a first gate line by driving a high supply voltage onto the first gate line via a first high drive transistor during a first gate pulse period. The first gate line is discharged through the first high drive transistor during a first discharge period following the first gate pulse period. A low supply voltage is driven onto the first gate line via a first low drive transistor during a first gate off period following the first discharge period. A second gate pulse generator circuit receives the gate timing control signals. A second gate pulse is generated on a second gate line by driving the high supply voltage onto the second gate line via a second high drive transistor during a second gate pulse period. The second gate line is discharged through the second high drive transistor during a second discharge period following the second gate pulse period. The low supply voltage is driven onto the second gate line via a second low drive transistor during a second gate off period following the second discharge period. The first gate pulse modulation circuit provides the high supply voltage to the first gate pulse generator and the second gate pulse generator via an output terminal during the first pulse period and the second pulse period. The first gate pulse modulation circuit couples a source terminal of the first high drive transistor and a source terminal of the second high drive transistor to a first return line via the output terminal during the first and second discharge periods.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Figure 1:
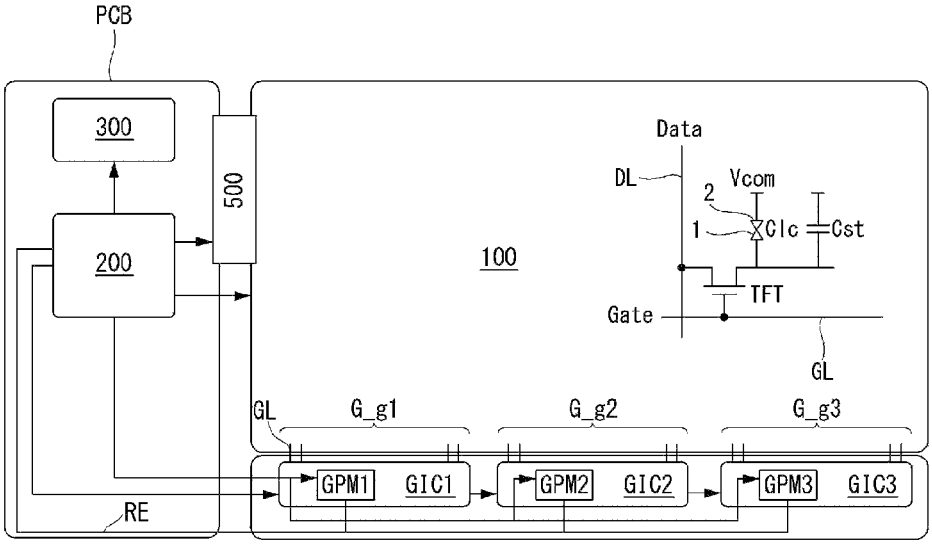
FIGS. 1 and 2 are views showing a display device according to the present invention.

Hereinafter, exemplary embodiments of the present invention will be described with reference to the drawings. Throughout the specification, like reference numerals denote substantially like components. In the following description, if it is decided that the detailed description of known function or configuration related to the invention makes the subject matter of the invention unclear, the detailed description is omitted.

Although this specification describes the present invention based on exemplary embodiments of a liquid crystal display, the present invention may be applicable to field emission displays (FEDs), plasma display panels (PDPs), organic light emitting diode devices (OLEDs), and so on.

Figure 2:
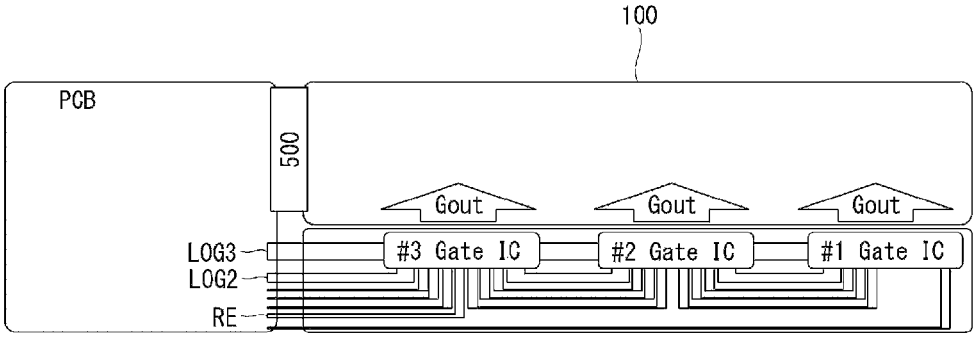
Figure 3:
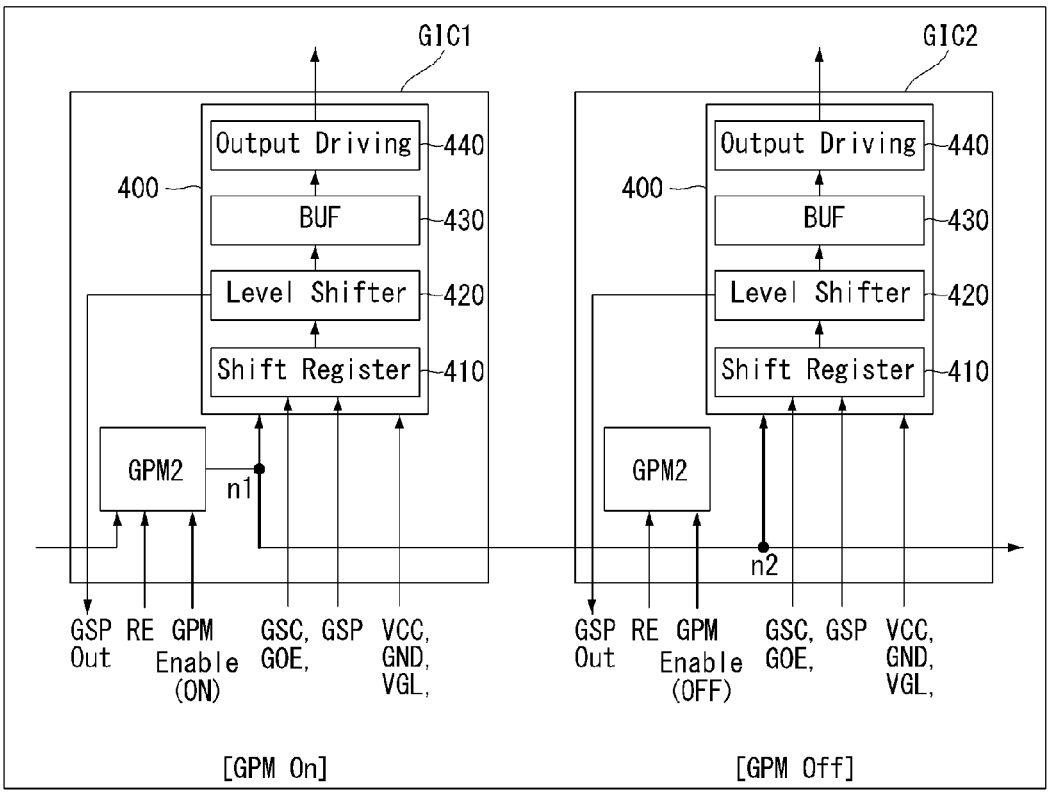
FIGS. 3, 4*a*, and 4*b* are views showing a configuration of gate drive ICs.

FIG. 1 is a view showing a display device according to the present invention, FIG. 2 is a view showing layers of log lines in the display device of FIG. 1, and FIGS. 3 and 4 are views showing a configuration of gate drive ICs shown in FIG. 1.

Referring to FIGS. 1 to 4, a display device of this invention comprises a display panel 100, a power module 200, a timing controller 300, gate drive ICs GIC, and source drive ICs 500.

The display panel 100 comprises a pixel array with a matrix of pixels to display input image data. The pixel array comprises a TFT array formed on a lower substrate, a color filter array formed on an upper substrate, and liquid crystal cells Clc formed between the upper and lower substrates. On the TFT array are data lines DL, gate lines GL intersecting the data lines DL, TFTs formed at every intersection between the data lines DL and the gate lines GL, pixel electrodes 1 connected to the TFTs, storage capacitors Cst, and so on. On the color filter array, a black matrix and color filters are formed. A common electrode 2 may be formed on either the lower substrate or the upper substrate. The liquid crystal cells Clc are driven by an electric field between the pixel electrodes 1 supplied with a data voltage and the common electrode 2 supplied with a common voltage Vcom. Polarizers with optical axes orthogonal to each other are attached to the upper and lower substrates of the display panel 100, and an alignment film for setting a pre-tilt angle of liquid crystals is formed at an interface contacting a liquid crystal layer.

The display panel 100 comprises a plurality of gate groups G_g, e.g., first to third gate groups G_g1 to G_g3. The first to third gate groups G_g1 to G_g3 comprise a plurality of gate lines.

The power module 200 starts to operate when an input voltage Vin is above an UVLO level, and produces output after a delay of a predetermined time. The output of the power module 200 comprises VGH, VGL, VCC, VDD, etc. The VCC may be a logic power supply voltage of, for example, 3.3 V, for driving the timing controller 300, gate drive ICs GIC, and source drive ICs 500. The VDD may be a high power supply voltage that is to be supplied to a voltage-dividing circuit in a gamma reference voltage generating circuit for generating positive/negative gamma reference voltages. The positive/negative gamma reference voltages are supplied to the source drive ICs 500.

The timing controller 300 receives digital video data RGB from an external host, and receives timing signals such as a vertical synchronization signal Vsync, a horizontal synchronization signal Hsync, a data enable signal DE, a main clock CLK, etc. The timing controller 300 transmits the digital video data RGB to the source drive ICs 500. The timing controller 300 generates a source timing control signal for controlling the operation timing of the source drive ICs 500, and gate timing control signals ST, GCLK, and MCLK for controlling the operation timings of level shifters 410 and shifter registers 420 of the gate drive ICs GIC.

Also, the timing controller 300 outputs a GPM control signal GPM enable. The GPM control signal GPM enable determines whether to enable the gate pulse modulators GPM or not. A first gate drive IC GIC1 receives a GPM control signal GPM enable of first logic, and second drive IC GIC2 and third drive IC GIC3 receive a GPM control signal GPM enable of second logic. The GPM control signal GPM enable of first logic enables the gate pulse modulators GPM, and the GPM control signal GPM enable of second logic disables the gate pulse modulators GPM.

The source drive ICs 500 comprises a plurality of source drive ICs (integrated circuits) 500. The source drive ICs 500 receive digital video data RGB from the timing controller 300. The source drive ICs 500 receive digital video data RGB from the timing controller 300. The source drive ICs 500 convert the digital video data RGB to a positive/negative analog data voltage in response to a source timing control signal from the timing controller 300, and then supply the data voltage to the data lines DL of the display panel 100, in synchronization with a gate pulse (or scan pulse).

The gate drive ICs GIC output gate pulses Gout by using gate timing control signals.

The gate timing control signals comprise a gate start pulse GSP, a gate shift clock GSC, and a gate output enable GOE. The gate start pulse GSP indicates a start line at which the gate drive ICs GIC output a first gate pulse Gout. The gate shift clock GSC is a clock for shifting the gate start pulse GSP. A GIC receives the GSP at an edge of the GSC which then triggers the next GIC in sequence to output the GSP at the next edge of the GSC. The gate output enable GOE is for setting the duration of a gate pulse Gout.

Each gate drive IC GIC comprises a gate pulse generator 400 and a gate pulse modulator GPM.

The gate pulse generator 400 comprises a shift register 410, a level shifter 420, a buffer 430, and an output part 440. The shift register 410 sequentially shifts the gate start pulse GSP according to the gate shift clock GSC by using a plurality of flip flops connected as a cascade. The level shifter 420 varies the shift register 410's output to a voltage level at which the TFTs on the display panel can be run. The buffer 430 amplifies the output of the level shifter 420 and the output part 440 outputs the amplified gate pulse.

Figure 5:
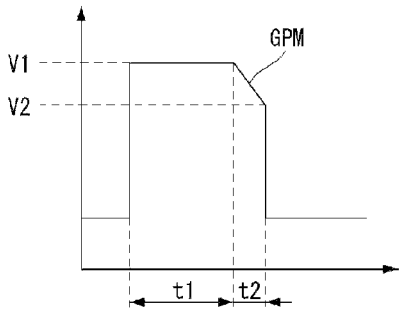
FIG. 5 is a view showing an example of a GPM signal.

A first gate pulse modulator GPM1 modulates the voltage level of a gate pulse Gout generated by a first gate pulse generator 400-1. FIG. 5 is a view showing a gate pulse modulated by a gate pulse modulator GPM. As shown in the drawing, the gate pulse modulator GPM varies the falling slope of the gate pulse Gout. An operation of a signal (hereinafter, GPM) for varying the falling slope of the gate pulse Gout shown in FIG. 5 is a well-known art, so a detailed description thereof will be omitted.

The second gate pulse modulator GPM2 and the third gate pulse modulator GPM3 are selectively enabled by a GPM control signal GPM enable from the timing controller 300. That is, the second gate pulse modulator GPM2 and the third gate pulse modulator GPM3 do not become enabled by the input of a GPM control signal of a second voltage level.

The first gate pulse modulator GPM1 discharges a gate pulse Gout output from the gate pulse generator 400 to generate a GPM signal. This will be discussed with reference to FIGS. 4*a*, 4*b* and 5.

The first gate pulse modulator GPM1 comprises a first logic circuit LOGIC1 and a first CMOS inverter circuit INV1.

The first logic circuit LOGIC1 sequentially shifts gate timing signals such as a gate start clock GSC and a gate output enable GOE to generate an inverter control signal sequentially alternating between pulse on-periods and pulse off-periods. The first CMOS inverter circuit INV1 receives the inverter control signal. In response to the inverter control signal, the first CMOS inverter circuit INV1 couples the high supply voltage VGH to the output terminal of the first CMOS inverter circuit INV1 during the pulse on-periods and couples the RE line to the output terminal during the pulse off-periods of the inverter control signal. Particularly, the first CMOS inverter circuit INV1 comprises a first transistor T11 (e.g., a high inverter transistor) and a second transistor T12 (e.g., a low inverter transistor). A gate electrode of the first transistor T11 is connected to an output of the first logic circuit LOGIC1, its drain electrode is connected to a high-voltage input, and its source electrode is connected to a first output terminal n1. A gate electrode of the second transistor T12 is connected to the output of the first logic circuit LOGIC1, its drain electrode is connected to a low voltage (VGL) input, and its source electrode is connected to the first output terminal n1.

During a first period t1 (e.g., a gate pulse period), the first transistor T11 of the first gate pulse modulator GPM1 is turned on in response to an output of the first logic circuit LOGIC1. With the first transistor T11 being turned on, a high voltage VGH received at the drain electrode is provided to the output part 440 of the gate pulse generator 400-1. A P-type element T13 of the output part 440 outputs the high voltage VGH at a first voltage level, and the gate pulse Gout remains at the first voltage level.

During a second period t2 (e.g., a discharge period), the second transistor T12 of the first gate pulse modulator GPM1 is turned on in response to an output of the logic part LOGIC1. With the second transistor T12 being turned on, the output voltage of the output part 440 of the gate pulse generator 400 is discharged via the second transistor T12. That is, during the second period t2, the voltage level of the gate pulse Gout gradually decreases from the first voltage level VGH to a second voltage level VGH2, whereby a GPM signal is generated. During a third period t3 (e.g., a gate off period), transistor T14 turn on to couple the gate pulse output Gout to the low voltage VGL.

Through this process, as described above, the logic part LOGIC of the second gate pulse modulator GPM2 of the second gate drive IC GIC2 is disabled (off) by a GPM control signal GPM enable.

The second gate drive IC GIC2 generates a GPM signal by using the first gate pulse modulator GPM1 in place of the second gate pulse modulator GPM2.

A voltage discharge path for GPM signal generation of the second gate drive IC GIC2 will be discussed below.

Each gate drive IC GIC is connected through conductive pads PAD formed on the display panel 100. A first conductive pattern L21 and a second conductive pattern L22 are formed within each gate drive IC GIC. The first conductive pad PAD1 connects the first output terminal n1 of the first gate pulse modulator GPM1 and the second output terminal n2 of the second gate pulse modulator GPM2. The first conductive pattern L21 of the second gate drive IC GIC2 connects the first conductive pad PAD1 and the second output terminal n2.

Figure 4A:
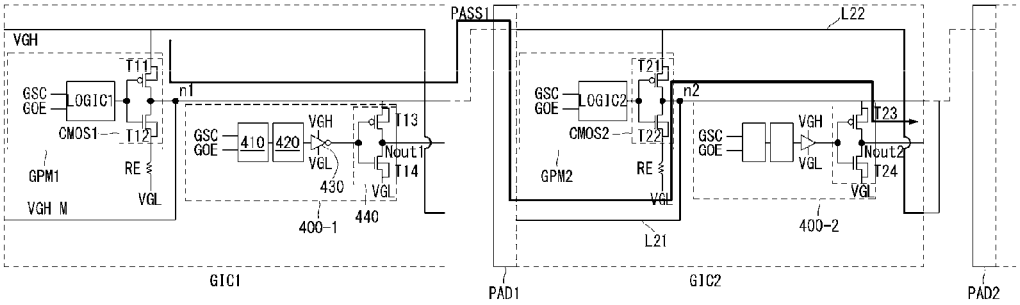

Due to this, the second output part 440-2 of the second gate drive IC GIC2 receives a high voltage and outputs a gate pulse, through a first path pass1 connecting the first output terminal n1 of the gate pulse modulator GPM of the first gate drive IC GIC1 and the conductive pad PAD1 and first conductive pattern L21 of the second gate drive IC GIC2 as illustrated in FIG. 4*a*.

Figure 4B:
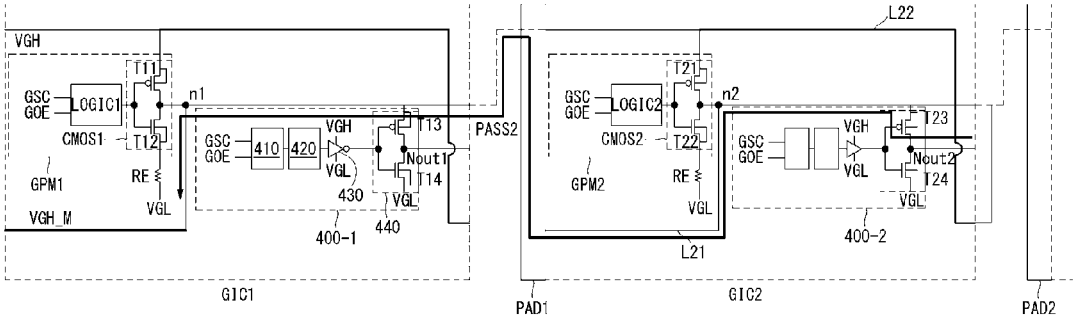

The second output part 440-2 of the second gate drive IC GIC2 generates a GPM signal by discharging the gate pulse of the first voltage level VGH through a second path pass2 connecting the first conductive pattern L21 and first conductive pad PAD1 and the output and first log line RE of the first gate pulse modulator GPM1 as illustrated in FIG. 4*b*. The RE line includes a resistor coupled between the low supply voltage VGL and the first output terminal n1.

The second conductive pattern L22 of the second gate drive IC GIC2 electrically connects the first conductive pad PAD1 and the third gate drive IC GIC3. In the described embodiment, no connection is present directly between PAD1 and T21, and instead output signal n2 connects to PAD1 via conductive pattern L21.

In this way, the second gate drive IC GIC2 and the third gate drive IC GIC3 may generate GPM signals without enabling the second gate pulse modulator GPM2 and the third gate pulse modulator GPM3, respectively. That is, as shown in FIG. 2, the display device according to the exemplary embodiment of the present invention may work without the first log lines being connected to the second gate pulse modulator GPM2 and the third gate pulse modulator GPM3. Accordingly, the area of the display panel where first log lines are disposed may be reduced, compared to a comparative example shown in FIG. 6 in which the gate pulse modulators GPM of all the gate drive ICs GIC are enabled.

Figure 6:
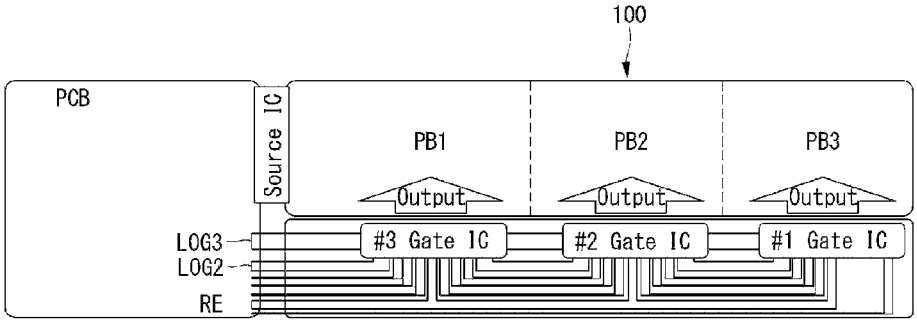
FIG. 6 is a view showing a display device according to a comparative example.
Figure 7:
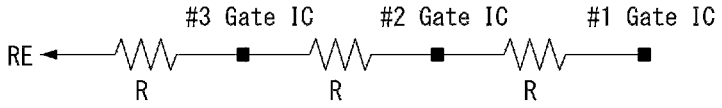
FIG. 7 is an equivalent circuit diagram showing differences in resistance between RE log lines in the display device of FIG. 6.

Also, in the comparative example shown in FIG. 6, the first log lines RE of all the gate drive ICs GIC are connected together to a low voltage VGL source through a printed circuit board PCB. Accordingly, the first log lines RE connecting all the gate drive ICs GIC and the low-voltage source have different resistance values. For example, as shown in FIG. 7, if the resistance value of the first log line RE of the third gate drive IC GIC3 is R, the resistance value of the first log line RE of the first gate drive IC GIC1 is 3R. That is, each gate drive IC outputs GPM signals with different waveforms because the GPM signals are generated based on the first log lines RE having different resistance values. Accordingly, block dimming occurs to panel blocks PB1 to PB3 the gate drive ICs GIC are in charge of, due to differences in gate pulse delay time.

On the contrary, in the exemplary embodiment of the present invention, all the gate drive ICs GIC generate GPM signals through the first log line RE of the first gate drive IC GIC1, and therefore the differences in gate pulse delay time, caused by the different resistance values of the first log lines of the gate drive ICs GIC, may be avoided.

Also, the second gate drive IC GIC2 and third gate drive IC GIC3 of this invention may be connected to the gate pulse modulator GPM1 of the first gate drive IC GIC1 through the first conductive pad PAD1 and the second conductive pad PAD2.

In the comparative example shown in FIG. 6, the second gate drive IC GIC2 receives a high voltage through the first transistor T21 of the second gate pulse modulator GPM2. Accordingly, there is a gate pulse output deviation between the second gate drive IC GIC2 and the first gate drive IC GIC1, due to a turn-on resistance of the first transistor T21 of the second gate pulse modulator GPM2.

On the other hand, the second gate drive IC GIC2 according to the exemplary embodiment of the present invention may generate a GPM signal through the first conductive pattern L21 and the conductive pad PAD1. This may eliminate the turn-on resistance of the transistor.

The foregoing exemplary embodiment of the present invention has been described with respect to an example where each gate drive IC GIC is equipped with a gate pulse modulator GPM. That is, the exemplary embodiment of the present invention may be applicable to a conventional display device using gate drive ICs GIC each equipped with a gate pulse modulator GPM.

Although not shown, the present invention may encompass an exemplary embodiment in which the second gate drive IC GIC2 and third gate drive IC GIC3 are not equipped with the second gate pulse modulator GPM2 and third gate pulse modulator GPM3. This exemplary embodiment, where the second gate pulse modulator GPM2 and the third gate pulse modulator GPM3 are omitted, may avoid differences in resistance between the first log lines RE and differences in turn-on resistance between the first transistors.

Although embodiments have been described with reference to a number of illustrative embodiments thereof it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gate driver for a display panel, comprising:

a first gate pulse generator circuit to receive gate timing control signals and to generate a first gate pulse on a first gate line by driving a high supply voltage onto the first gate line via a first high drive transistor during a first gate pulse period, to discharge the first gate line through the first high drive transistor during a first discharge period following the first gate pulse period, and to drive a low supply voltage onto the first gate line via a first low drive transistor during a first gate off period following the first discharge period;

a second gate pulse generator circuit to receive the gate timing control signals and to generate a second gate pulse on a second gate line by driving the high supply voltage onto the second gate line via a second high drive transistor during a second gate pulse period, to discharge the second gate line through the second high drive transistor during a second discharge period following the second gate pulse period, and to drive the low supply voltage onto the second gate line via a second low drive transistor during a second gate off period following the second discharge period;

a first gate pulse modulation circuit to provide the high supply voltage to the first gate pulse generator and the second gate pulse generator via an output terminal during the first pulse period and the second pulse period, and to couple a source terminal of the first high drive transistor and a source terminal of the second high drive transistor to a first return line via the output terminal during the first and second discharge periods.

2. The gate driver of claim 1, further comprising:

a first conductive pad coupled to the output terminal of the first gate pulse modulator circuit; and a first conductive pattern to couple the first conductive pad to a source terminal of the second high drive transistor.

3. The gate driver of claim 2, further comprising:

a second conductive pattern to connect the first conductive pad to a second conductive pad of a third gate pulse generator circuit.

4. The gate driver of claim 1, wherein the first gate pulse modulation circuit comprises:

a logic circuit to receive the gate timing control signal and generate an inverter control signal sequentially alternating between pulse on-periods and pulse off-periods; and an inverter circuit to receive the inverter control signal and to couple the high supply voltage to the output terminal during the pulse on-periods of the inverter control signal and to couple the return line to the output terminal during the pulse off-periods of the inverter control signal.

5. The gate driver of claim 4, wherein the inverter circuit comprises:

a high inverter transistor coupled between the high supply voltage and the output terminal, the high inverter transistor to couple the high supply voltage to the output terminal during the pulse on-periods; and a low inverter transistor coupled between the output terminal and the return line, the low inverter transistor to couple the return line to the output terminal during the pulse off-periods.

6. The gate driver of claim 1, wherein the first return line comprises a resistor coupled between the low supply voltage and the output terminal of the gate pulse modulation circuit.

7. The gate driver of claim 1, wherein the first gate pulse generator circuit and the first gate pulse modulation circuit are embodied in a first integrated circuit, and wherein the second gate pulse generator circuit is embodied in a second integrated circuit.

8. A gate driver integrated circuit, comprising:

a gate pulse generator circuit to receive gate timing control signals and to generate a gate pulse on a gate line by driving a high supply voltage onto the gate line via a high drive transistor during a gate pulse period, to discharge the gate line through the high drive transistor during a first discharge period following the gate pulse period, and to drive a low supply voltage onto the gate line via a first low drive transistor during a gate off period following the discharge period;

a gate pulse modulation circuit having an enable terminal to enable or disable the gate pulse modulation circuit, the gate pulse modulation circuit when enabled to provide the high supply voltage to the gate pulse generator circuit via an output terminal during the pulse period, and to couple a source terminal of the high drive transistor to a return line via the output terminal during the discharge period;

a first conductive pad coupled to receive the high supply voltage from an external source during the pulse period and to provide a discharge path to an external return line during the discharge period when the gate pulse modulation circuit is disabled; and a first conductive pattern to couple the first conductive pad to the source terminal of the high drive transistor when the gate pulse modulation circuit is disabled.

9. The gate driver integrated circuit of claim 8, further comprising:

a second conductive pattern to connect the first conductive pad to an external conductive pad.

10. The gate driver integrated circuit of claim 8, wherein the gate pulse modulation circuit comprises:

a logic circuit to receive the gate timing control signal and generate an inverter control signal sequentially alternating between pulse on-periods and pulse off-periods; and an inverter circuit to receive the inverter control signal and to couple the high supply voltage to the output terminal during the pulse on-periods of the inverter control signal and to couple the return line to the output terminal during the pulse off-periods of the inverter control signal.

11. The gate driver integrated circuit of claim 10, wherein the inverter circuit comprises:

a high inverter transistor coupled between the high supply voltage and the output terminal, the high inverter transistor to couple the high supply voltage to the output terminal during the pulse on-periods; and a low inverter transistor coupled between the output terminal and the return line, the high inverter transistor to couple the return line to the output terminal during the pulse off-periods.

12. The gate driver integrated circuit of claim 8, wherein the return line comprises a resistor coupled between the low supply voltage and the output terminal of the gate pulse modulation circuit.

13. A method for generate a gate driver signal comprising:

receiving, by a first gate pulse generator circuit, gate timing control signals;

generating, by the first gate pulse generator circuit, a first gate pulse on a first gate line by driving a high supply voltage onto the first gate line via a first high drive transistor during a first gate pulse period;

discharging the first gate line through the first high drive transistor during a first discharge period following the first gate pulse period;

driving a low supply voltage onto the first gate line via a first low drive transistor during a first gate off period following the first discharge period;

receiving by a second gate pulse generator circuit, the gate timing control signals;

generating a second gate pulse on a second gate line by driving the high supply voltage onto the second gate line via a second high drive transistor during a second gate pulse period;

discharging the second gate line through the second high drive transistor during a second discharge period following the second gate pulse period;

driving the low supply voltage onto the second gate line via a second low drive transistor during a second gate off period following the second discharge period;

providing, by a first gate pulse modulation circuit, the high supply voltage to the first gate pulse generator and the second gate pulse generator via an output terminal during the first gate pulse period and the second gate pulse period; and coupling, by the first gate pulse modulation circuit, a source terminal of the first high drive transistor and a source terminal of the second high drive transistor to a first return line via the output terminal during the first and second discharge periods.

14. The method of claim 13, further comprising:

providing the high supply voltage to a source terminal of the second high drive transistor via a first conductive pad coupled to the output terminal of the first gate pulse modulator circuit and a first conductive pattern coupled between the first conductive pad and the source terminal of the second high drive transistor.

15. The method of claim 14, further comprising:

providing the high supply voltage to a third gate pulse generator circuit via a second conductive pattern coupling the first conductive pad to a second conductive pad of the third gate pulse generator circuit.

16. The method of claim 13, wherein providing the high supply voltage to the first gate pulse generator and the second gate pulse generator comprises:

receiving, by a first logic circuit, the gate timing control signal;

generating an inverter control signal sequentially alternating between pulse on-periods and pulse off-periods; and controlling a high inverter transistor to couple the high supply voltage to the output terminal during the pulse on-periods of the inverter control signal.

17. The method of claim 16, wherein coupling the source terminal of the first high drive transistor and the source terminal of the second high drive transistor to the first return line comprises:

turning on a low inverter transistor coupled between the return line and the output terminal to couple the return line to the output terminal during the pulse off-periods of the inverter control signal.

* * * * *